US005412952A

United States Patent [19]

Ohtani et al.

[11] Patent Number: 5,412,952

[45] Date of Patent: May 9, 1995

[54] PULSE TUBE REFRIGERATOR

[75] Inventors: Yasumi Ohtani; Hideo Hatakeyama; Toru Kuriyama, all of Yokohama; Hideki Nakagome, Tokyo; Yoichi Matsubara, Funabashi, all of Japan

[73] Assignee: Kabushiki Kaisha Toshiba, Kawasaki, Japan

[21] Appl. No.: 252,270

[22] Filed: Jun. 1, 1994

Related U.S. Application Data

[62] Division of Ser. No. 65,900, May 25, 1993, Pat. No. 5,335,505.

[30] Foreign Application Priority Data

May 25, 1992 [JP] Japan ..... 4-132523
Sep. 18, 1992 [JP] Japan ..... 4-249988

[51] Int. Cl.[6] ..... F25B 9/00

[52] U.S. Cl. ..... 62/6; 62/48.3; 62/467

[58] Field of Search ..... 62/6, 467, 47.1, 48.3

[56] References Cited

U.S. PATENT DOCUMENTS 3,406,526 10/1968 Lusk ..... 62/48.3
3,817,044 6/1974 Daniels ..... 62/6
4,277,949 7/1981 Longsworth ..... 62/47.1
5,107,683 4/1992 Chan et al. ..... 62/6
5,269,147 12/1993 Ishizaki et al. ..... 62/6
5,275,002 1/1994 Inoue et al. ..... 62/6
5,295,355 3/1994 Zhou et al. ..... 62/6

*Primary Examiner*—William E. Tapolcai
*Attorney, Agent, or Firm*—Oblon, Spivak, McClelland, Maier & Neustadt

[57] ABSTRACT

The present invention provides a pulse tube refrigerator, comprising a regenerator having an inlet port and an outlet port, a pulse tube having one end portion connected in series to the outlet port of the regenerator, a gas compressor connected to the inlet port of the regenerator, a first valve disposed between the discharge port of the gas compressor and the inlet port of the regenerator, a second valve disposed between the suction port of the gas compressor and the inlet port of the regenerator, a first valve controller for selectively opening/closing alternately the first and second valves to permit a high pressure coolant gas discharged from the discharge port of the gas compressor to be guided into the pulse tube through the regenerator and, then, to permit said coolant gas to be sucked into the gas compressor through the suction port thereof via the reverse passageway so as to generate coldness, a third valve disposed between the other end portion of the pulse tube and the discharge port of the gas compressor, a fourth valve disposed between the other end portion of the pulse tube and the suction port of the gas compressor, and a second valve controller serving to open/close the third and fourth valves in relation to the opening/-closing of the first and second valves.

41 Claims, 13 Drawing Sheets

PULSE TUBE REFRIGERATOR

This is a division, of application Ser. No. 08/065/900, filed on May, 25, 1993, now U.S. Pat. No. 5, 335,535.

BACKGROUND OF THE INVENTION

1. Field of the Invention

The present invention relates to a pulse tube refrigerator, particularly to a pulse tube refrigerator which permits improving the efficiency.

2. Description of the Related Art

A pulse tube refrigerator is known to the art as a refrigerator which is relatively simple in construction and which permits reaching a relatively low temperature. various types of pulse tube refrigerators of this kind are known to the art. Any type of the pulse tube refrigerator basically comprises a coldness generator consisting of a regenerator and a pulse tube connected in series to the regenerator and is constructed such that a coolant gas of a high pressure is introduced through the regenerator into the pulse tube and, then, discharged to the outside via the reverse passageway. During the process of the discharge to the outside, the high pressure coolant gas is expanded so as to generate coldness within the pulse tube.

In order to increase the coldness generation in a pulse tube refrigerator of this type, it is necessary to provide a difference between the phase in the pressure fluctuation within the pulse tube and the phase in the displacement of the coolant gas. Because of the particular requirement, a system for providing such a phase difference is provided in many cases in the conventional pulse tube refrigerator.

FIG. 1 shows a conventional pulse tube refrigerator comprising a system for providing a phase difference. A reference numeral 1 in FIG. 1 denotes a coldness generator, with a rotary gas compressor being denoted by a reference numeral 2. As shown in the drawing, the coldness generator 1 comprises a regenerator 3 and a pulse tube 5 connected in series to the regenerator 3 with a low temperature heat exchanger 4 interposed therebetween. The regenerator 3 comprises a vessel 6 made of a heat insulating material or a metallic material having a low thermal conductivity and a refrigerant 7 housed in the vessel 6. The refrigerant 7 is formed of, for example, a stainless steel mesh or a copper mesh. On the other hand, the pulse tube 5 is formed into a pipe and is made of a heat insulating material or a metallic material having a low thermal conductivity.

An inlet 8 of the regenerator 3 is connected to a discharge passageway 11 and to a suction passageway 12 of a gas compressor 2 via a high pressure valve 9 and a low pressure valve 10, respectively. These high pressure valve 9 and low pressure valve 10 are alternately allowed to be opened or closed periodically by a valve controller (not shown). To be more specific, these valves 9 and 10 are controlled such that, when one of these valves is opened, the other valve is closed, and vice versa.

On the other hand, a pipe 13 for a so-called double inlet passageway (hereinafter referred to as "double inlet line 13") is provided between one end (or upper end in the drawing) of the pulse tube 5 and the inlet 8 of the regenerator 3. A valve 14 for controlling the coolant gas flow rate is disposed midway of the double inlet line 13. Said one end portion of the pulse tube 5 is also connected to a buffer tank 16 via an orifice valve 15. A coolant gas such as a helium gas is sealed with a predetermined pressure within the system described above.

In the conventional pulse tube refrigerator of the construction described above, a pressure fluctuation is generated within the pulse tube 5 by the alternate opening/closing of the high pressure valve 9 and the low pressure valve 10. What should be noted is that coldness is generated within the pulse tube 5 by providing a difference in phase between the pressure fluctuation and the displacement of the coolant gas. The coldness thus generated partly serves to cool an object to be cooled via the low temperature heat exchanger. The remainder of the coldness is subjected to cooling of the refrigerant when the coolant gas flows via the reverse passageway.

In the system described above, it is possible to provide an optimum operating condition by controlling the degree of opening of each of the valve 14 and the orifice valve 15. In other words, the double inlet line 13, the valve 14, the orifice valve 15 and the buffer tank 16 collectively serve to form the phase difference referred to above.

FIG. 2 shows another conventional pulse tube refrigerator. Used in this refrigerator is a reciprocating gas compressor. To be more specific, a gas compressor **2*b* connected to the inlet 8 of the regenerator 3 is of a reciprocating type, which comprises a compression chamber 18 defined by a cylinder 17*a* and a piston 17*b*. One end of a piston rod 17*c* is connected to the back surface of the piston 17*b*, with the other end being guided by a guide mechanism 19** so as to be joined to a reciprocating driving source (not shown).

In the conventional pulse tube refrigerator shown in FIG. 2, the piston **17*b* is moved upward in the drawing so as to diminish the inner volume of the compression chamber 18, with the result that the compressed gas flows partly through the regenerator 3 into the pulse tube 5 and partly through the pipe 14 into the pulse tube 5 and into the buffer tank 16. Then, when the piston 17*b* is moved downward, the coolant gas within the pulse tube 5 flows partly through the refrigerator 3 into the compression chamber 18 and partly through the double inlet line 13 into the compression chamber 18. The particular flow of the coolant gas brings about a pressure fluctuation within the pulse tube 5 so as to generate coldness. The coldness thus generated partly serves to cool the object to be cooled via the low temperature heat exchanger 4. The remainder of the coldness permits the refrigerant 7 to be cooled when the coolant gas flows through the reverse passageway. It should be noted that an optimum operating condition can be provided by controlling the degree of opening of each of the valve 14 and the orifice valve 15. In other words, the double inlet line 13, the valve 14, the orifice valve 15 and the buffer tank 16** collectively serve to form the phase difference referred to previously.

However, the conventional pulse tube refrigerators shown in FIGS. 1 and 2 give rise to serious problems. When it comes to the conventional pulse tube refrigerator shown in FIG. 1, the range of control of the phase difference noted previously is restricted by the opening/closing operation of each of the high pressure valve 9 and the low pressure valve 10. On the other hand, when it comes to the conventional pulse tube refrigerator shown in FIG. 2, the range of control of the phase difference is restricted by the gas compressor 2. In short, it is difficult to provide a sufficiently large phase difference in any of the conventional pulse tube refrigerators shown in FIGS. 1 and 2. It follows that the conventional pulse tube refrigerators shown in these drawings is lower in efficiency than a Starling refrigerator which comprises an expansion piston disposed in a low temperature portion, said expansion piston serving to forcedly provide a desired phase difference.

As described above, the conventional pulse tube refrigerator is advantageous in that a movable member need not be disposed in a low temperature portion, but leaves room for further improvement in terms of efficiency.

What should also be noted is that, in the conventional refrigerator shown in FIG. 2, the frictional resistance generated between the cylinder 17*a* and the piston 17*b* causes reduction in the compression efficiency, leading to reduction in the efficiency of the refrigerator.

SUMMARY OF THE INVENTION

An object of the present invention is to provide a pulse tube refrigerator which permits improving the refrigerating efficiency without impairing the merit of the pulse tube refrigerator that a movable member need not be disposed in a low temperature portion.

According to a first embodiment of the present invention, there is provided a pulse tube refrigerator, comprising a regenerator having an inlet port and an outlet port; a pulse tube having one end portion connected in series to the outlet port of the regenerator; a gas compressor connected to the inlet port of the regenerator; a first valve disposed between the discharge port of the gas compressor and the inlet port of the regenerator; a second valve disposed between the suction port of the gas compressor and the inlet port of the regenerator; a first valve control means for selectively opening/closing alternately the first and second valves to permit a high pressure coolant gas discharged from the discharge port of the gas compressor to be guided into the pulse tube through the regenerator and, then, to permit the coolant gas to be sucked into the gas compressor through the suction port thereof via the reverse passageway so as to generate coldness; a third valve disposed between the other end portion of the pulse tube and the discharge port of the gas compressor; a fourth valve disposed between the other end portion of the pulse tube and the suction port of the gas compressor; and a second valve control means serving to open/close the third and fourth valves in relation to the opening/closing of the first and second valves.

According to a second embodiment of the present invention, there is provided a pulse tube refrigerator, comprising a regenerator having an inlet port and an outlet port; a pulse tube having one end portion connected in series to the outlet port of the regenerator; a gas compressor connected to the inlet port of the regenerator; a first valve disposed between the discharge port of the gas compressor and the inlet port of the regenerator; a second valve disposed between the suction port of the gas compressor and the inlet port of the regenerator; a third valve disposed between the other end portion of the pulse tube and the discharge port of the gas compressor; a fourth valve disposed between the other end portion of the pulse tube and the suction port of the gas compressor; and a valve control means serving to control the opening/closing of the first, second, third and fourth valves, the valve control means serving to control the opening/closing of the valves to permit a first valve opening/closing operation and a second valve opening/closing operation to be carried out with,different phases, the first valve opening/closing operation being carried out such that a valve opening/closing operation in which the third valve is opened with the fourth valve being closed and another valve opening/closing operation in which the third valve is closed with the fourth valve being opened are carried out periodically, and the second valve opening/closing operation being carried out such that a valve opening/closing operation in which the first valve is opened with the second valve being closed and another valve opening/closing operation in which the first valve is closed with the second valve being opened are carried out periodically.

Further, according to a third embodiment of the present invention, there is provided a pulse tube refrigerator, comprising a first regenerator having an inlet port and an outlet port; a first pulse tube having one end portion connected in series to the outlet port of the first regenerator; a second regenerator having an inlet port and an outlet port, the inlet port being connected to the outlet port of the first regenerator; a second pulse tube having one end connected in series to the outlet port of the second regenerator; a heat conductor for thermally connecting the second pulse tube to a heat exchange portion formed at a connecting portion between the first regenerator and the first pulse tube; a housing containing the first regenerator, the first pulse tube, the second regenerator, and the second regenerator; a gas compressor connected to the inlet port of the first regenerator by means of a pipe hermetically extending trough a wall of the housing; and a conduit hermetically extending through a wall of the housing and connected to the other ends of the first and second pulse tube.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 3:
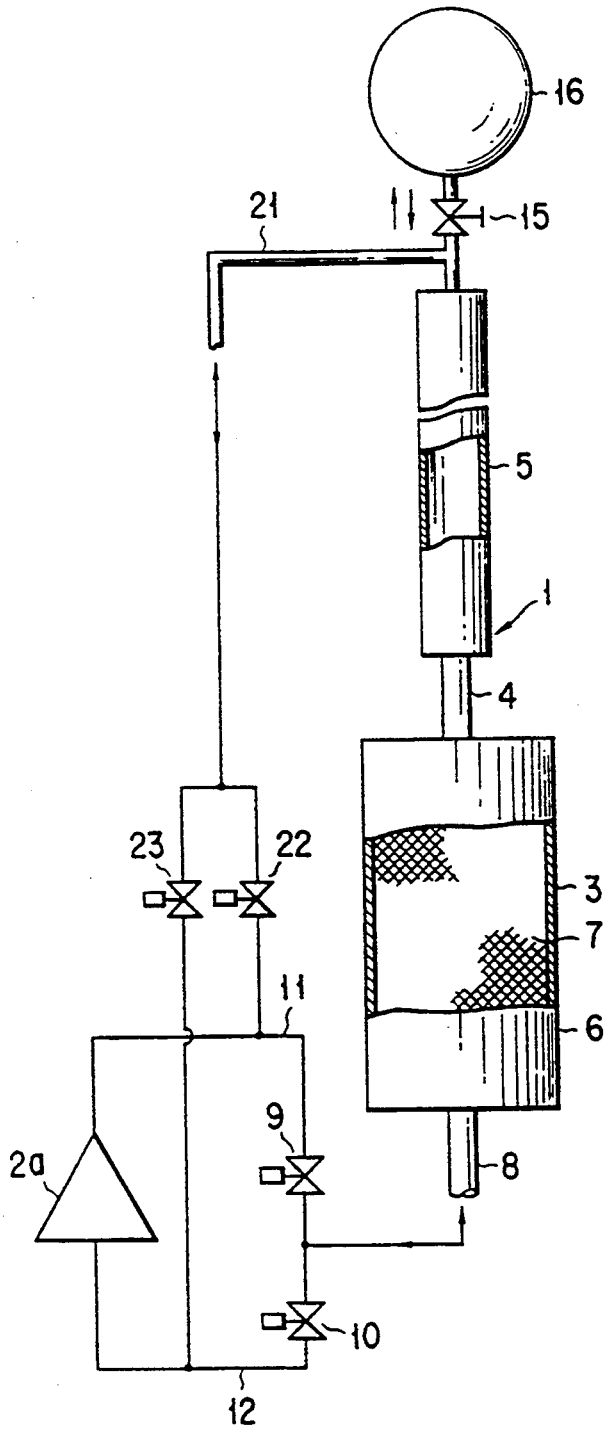
FIG. 3 schematically shows the construction of a pulse tube refrigerator according to one embodiment of the present invention.

Let us describe various embodiments of the present invention with reference to the accompanying drawings. First of all, FIG. 3 schematically shows the construction of a pulse tube refrigerator according to a first embodiment of the present invention. Reference numerals common with those in FIG. 1 denote the same members of the apparatus.

A reference numeral 1 in FIG. 3 denotes a coldness generator, with reference numeral 2 denoting a rotary gas compressor. As shown in the drawing, the coldness generator 1 comprises a regenerator 3 and a pulse tube 5 connected in series to the regenerator 3 with a low temperature heat exchanger 4 interposed therebetween.

The regenerator 3 comprises a vessel 6 formed of a heat insulating material or a metallic material having a low thermal conductivity and a refrigerant 7 housed in the vessel 6. The refrigerant 7 is formed of, for example, a stainless steel mesh or a copper mesh. On the other hand, pulse tube 5 is in the form of a pipe and is made of a heat insulating material or a metallic material having a low thermal conductivity.

The regenerator 3 has an inlet port 8 which is connected to a discharge passageway 11 and a suction passageway 12 of the gas compressor 2 via a high pressure valve 9 and a low pressure valve 10, respectively. These high pressure valve 9 and low 10 pressure valve 10 are controlled by a valve controller (not shown) such that these valves 9 and 10 are alternately opened/closed periodically.

The distal end portion (or upper end portion in the drawing) of the pulse tube 5 also communicates with a buffer tank 16 through an orifice valve 15. A coolant gas such as a helium gas is sealed with a predetermined pressure within the system described above.

Figure 1:
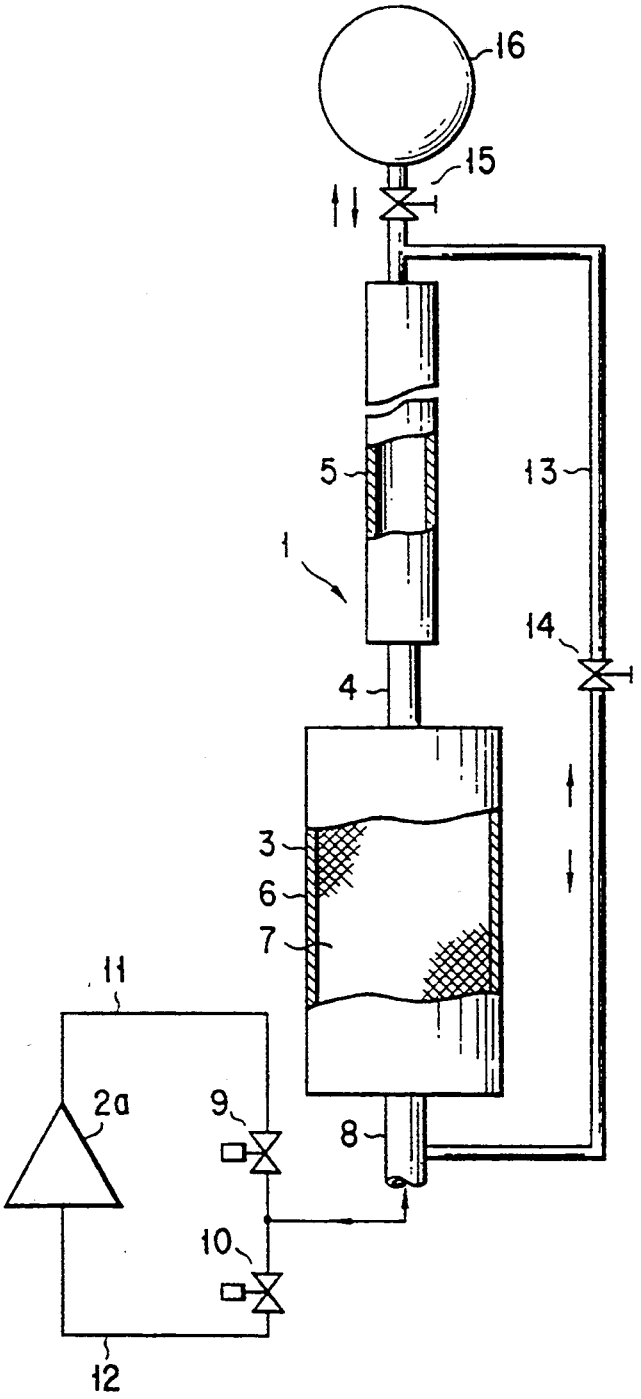
FIG. 1 (PRIOR ART)
FIG. 1 schematically shows the construction of a conventional pulse tube refrigerator.

The refrigerator shown in FIG. 3 is equal in the construction described above to the conventional refrigerator shown in FIG. 1. However, the pulse tube refrigerator of the present invention shown in FIG. 3 differs in construction of the double inlet passageway from the conventional refrigerator shown in FIG. 1.

Figure 4:
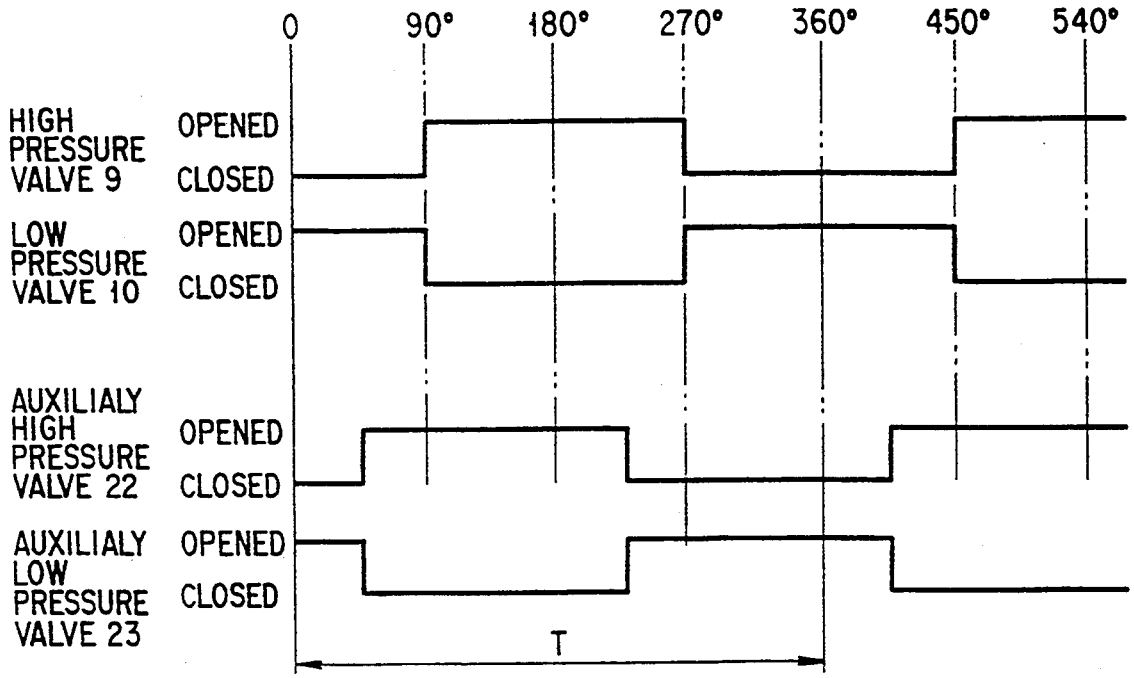
FIG. 4 is a timing chart showing the timing of the opening/closing operation four valves incorporated in the pulse tube refrigerator shown in FIG. 3.

Specifically, in the refrigerator shown in FIG. 3, one end of a pipe 21 is connected to the distal end portion of the pulse tube 5, with the other end of the pipe 21 being connected via an auxiliary high pressure valve 22 to that portion of a discharge passageway 11 of the gas compressor 2 which is positioned upstream of the high pressure valve 9 and being connected via an auxiliary low pressure valve 23 to that portion of a suction passageway 12 of the gas compressor 2 which is positioned downstream of the low pressure valve 10. These high pressure valve 9, low pressure valve 10, auxiliary high pressure valve 22 and auxiliary low pressure valve 23 are controlled by a valve controller (not shown) to be opened/closed in the timing shown in FIG. 4. In the example shown in FIG. 4, the high pressure valve 9 and the low pressure valve 10 are controlled to be alternately kept opened and, then, closed during the same period, the opening period of time being equal to the closing period of time. To be more specific, while the high pressure valve 9 is kept opened, the low pressure valve 10 is kept closed, and vice versa. The auxiliary high pressure valve 22 and the auxiliary low pressure valve 23 are controlled similarly to the high pressure valve 9 and the low pressure valve 10, except that the phase of the opening/closing timing for the auxiliary high pressure valve 22 and the auxiliary low pressure valve 23 is earlier by 45° than the phase of the opening/closing timing for the high pressure valve 9 and the low pressure valve 10.

The construction described above makes no difference in the refrigeration principle itself from the construction of the conventional refrigerator. It should be noted, however, that, in the refrigerator of the present invention shown in FIG. 3, the high pressure valve 9 is opened after the auxiliary high pressure valve 22 is opened, as apparent from FIG. 4. Likewise, the high pressure valve 9 is closed after the auxiliary low pressure valve 23 is opened. It follows that the distal end portion of the pulse tube 5 is allowed to communicate with the discharge port and the suction port of the gas compressor 2 regardless of the opening/closing period of the high pressure valve 9 and the low pressure valve 10. It follows that the refrigerator shown in FIG. 3 permits increasing the difference in phase between the pressure fluctuation and the displacement of the coolant gas within the pulse tube 5, making it possible to improve the refrigerating efficiency, compared with the conventional refrigerator.

Figure 5:
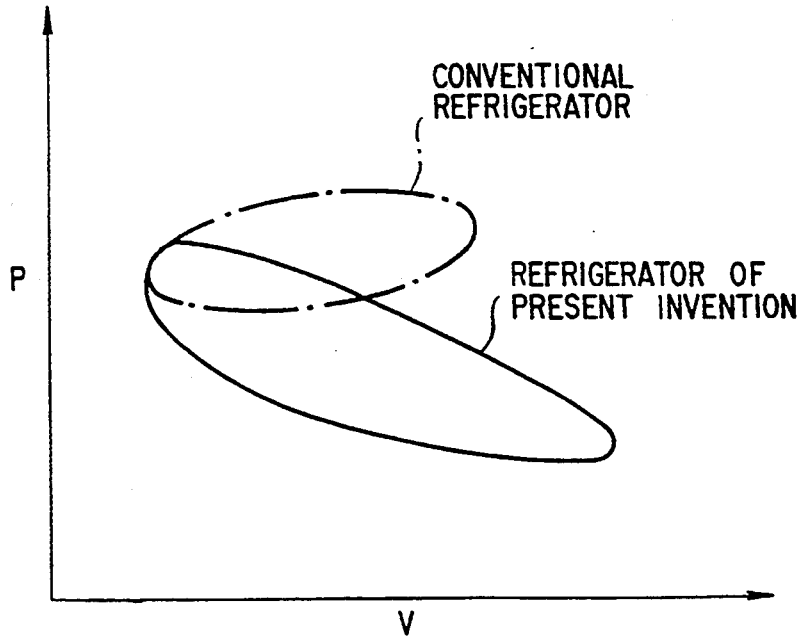
FIG. 5 is a graph showing an imaginary P-V characteristics of the pulse tube refrigerator shown in FIG. 3 in comparison with those of the conventional pulse tube refrigerator.

FIG. 5 shows the imaginary P-v curve in the low temperature expanding portion with respect to the pulse tube refrigerator of the present invention shown in FIG. 3 and the conventional pulse tube refrigerator shown in FIG. 1. The two curves shown in FIG. 5 were prepared under the same conditions, except that the data used for preparing the curve for the refrigerator of the present invention had been calculated on the basis of the control timing shown in FIG. 4. As apparent from FIG. 4, changes in P and v can be markedly enlarged in the refrigerator of the present invention. This is because the phase difference noted above can be enlarged in the refrigerator of the present invention, as described previously. It follows that the refrigerator of the present invention permits increasing the coldness generation, leading to an improved efficiency.

Figure 6:
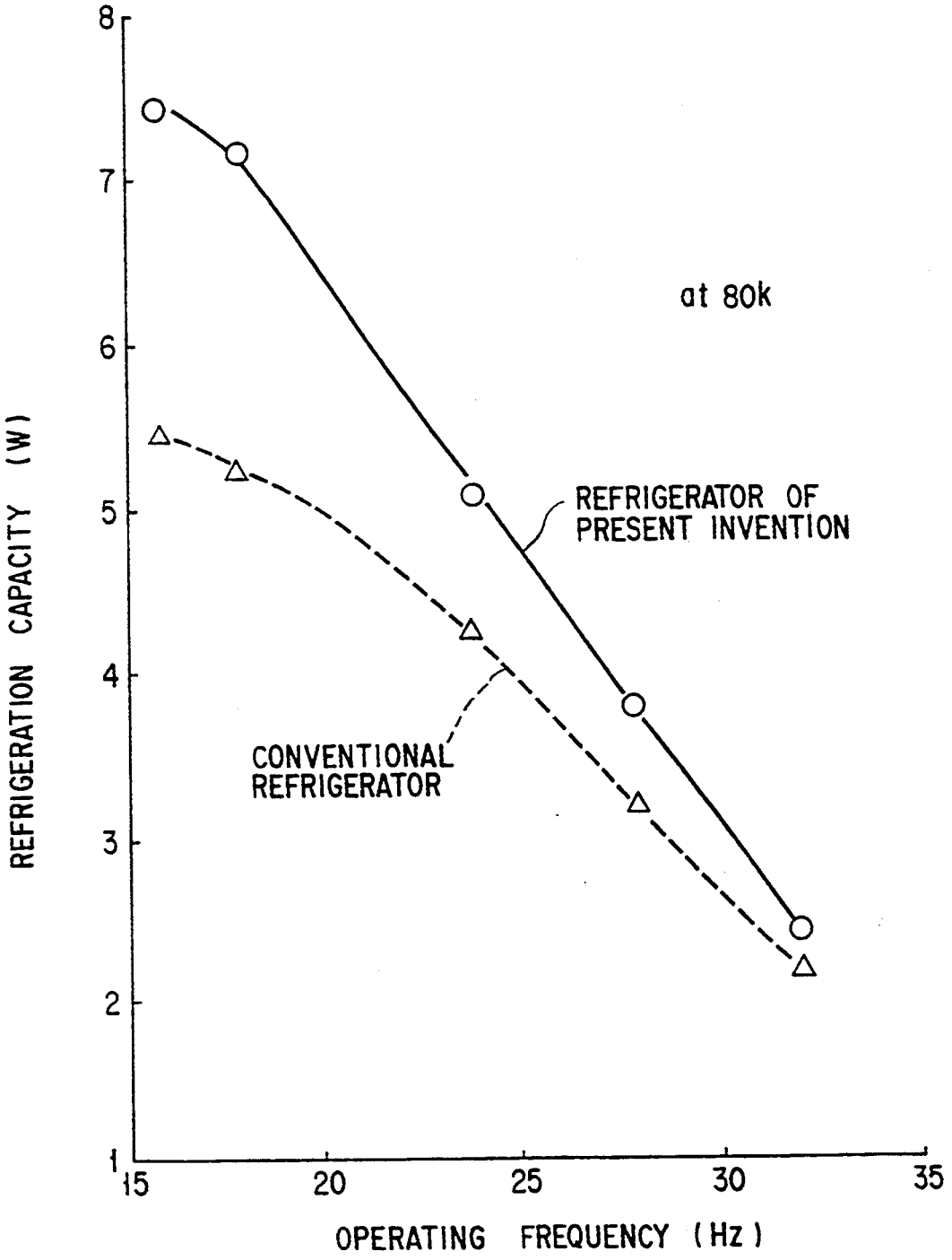
FIG. 6 is a graph showing the refrigerating characteristics at 80K of the pulse tube refrigerator shown in FIG. 3 in comparison with those of the conventional pulse tube refrigerator.

FIG. 6 is a graph showing the refrigerating characteristics at 80K of the pulse tube refrigerator of the present invention shown in FIG. 3 in comparison with those of the conventional pulse tube refrigerator shown in FIG. 1. As apparent from FIG. 6, the refrigerator of the present invention, which permits increasing the coldness generation as described above, exhibits excellent refrigerating characteristics, compared with the conventional refrigerator.

Figure 7:
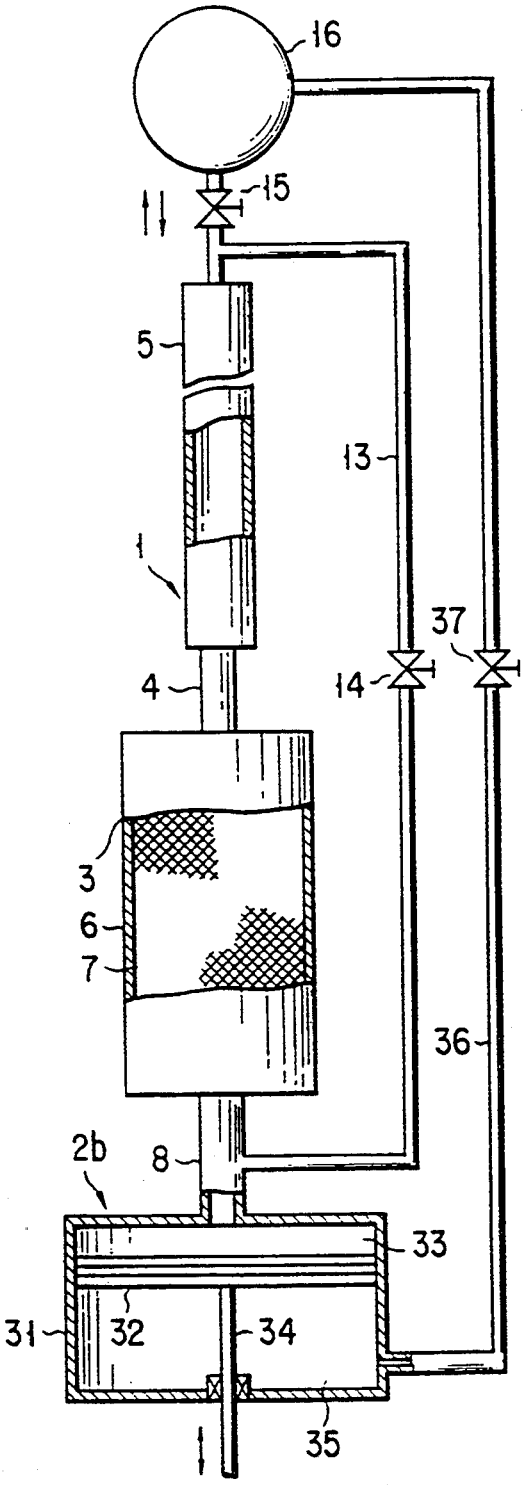
FIG. 7 schematically shows the construction of a pulse tube refrigerator according to another embodiment of the present invention.

FIG. 7 schematically shows the construction of a pulse tube refrigerator according to a second embodiment of the present invention. In this embodiment, used is a reciprocating compressor. The reference numerals common with FIGS. 3 and 7 denote the same members of the refrigerator. The pulse tube refrigerator shown in FIG. 7 differs from the conventional refrigerator shown in FIG. 2 in the system of the coolant gas passageway.

As shown in FIG. 7, a gas compressor *2a* is in the form of a reciprocating compressor comprising a compression chamber 33 defined by a cylinder 31 and a piston 32. The bottom wall of the cylinder 31 is closed, and a piston rod 34 is hermetically slidable through the bottom wall of the cylinder 31 and is Joined to a driving apparatus (not shown). Further, the compression chamber 33 is connected to the inlet port 8 of the regenerator 3. On the other hand, a back chamber 35 formed behind the compression chamber 33 with the piston 32 interposed therebetween communicates with the buffer tank 16 via a pipe 36 and a flow rate control valve 37.

In the pulse tube refrigerator of the construction described above, the piston 32 is moved upward in the drawing to diminish the inner volume of the compression chamber 33. As a result, the compressed coolant gas partly flows through the regenerator 3 into the pulse tube 5 and partly flows through the double inlet line 13 into the pulse tube 5 and into the buffer tank 16. In this case, the coolant gas within the buffer tank 16 partly flows through a pipe 36 into the back chamber 35.

When the piston 32 is moved downward in the next step, the coolant gas within the pulse tube 5 flows partly through the regenerator 3 into the compression chamber 33 and partly through the double inlet line 13 into the compression chamber 33. In this step, the coolant gas within the back chamber 35 flows through the double inlet line 13 into the buffer tank 16. On the other hand, the coolant gas within the buffer tank 16 flows through the double inlet line 13 into the pulse tube 5. What should be noted is that a pressure fluctuation is brought about within the pulse tube 5 by the particular flow of the coolant gas described above. It follows that a difference in phase is brought about between the pressure fluctuation and the displacement of the coolant gas so as to generate coldness.

Figure 2:
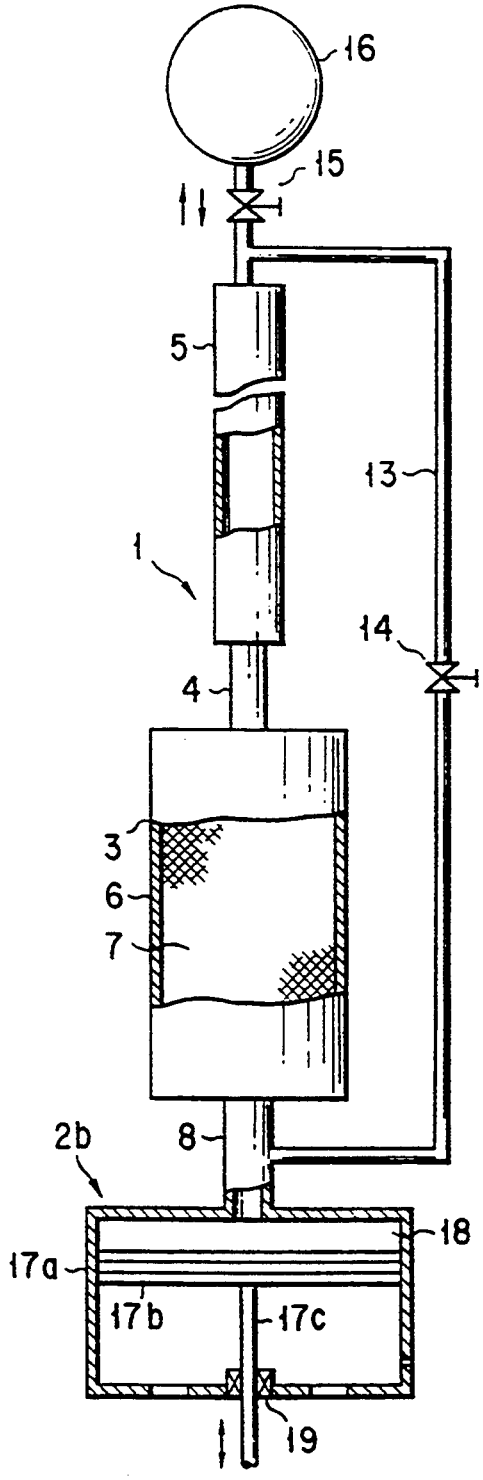
FIG. 2 (PRIOR ART)
FIG. 2 schematically shows the construction of another conventional pulse tube refrigerator.

According to the experiment conducted by the present inventors, the coldness generation within the refrigerator of the present invention shown in FIG. 7 was much greater than that in the conventional refrigerator shown in FIG. 2. The reason for the prominent effect produced by the refrigerator of the present invention has not yet been clarified completely. However, it is considered reasonable to understand that the particular construction of the refrigerator employed in the present invention permits increasing the phase difference noted above, leading to the prominent effect noted above.

Used in the experiment noted above was a refrigerator comprising a gas compressor *2a* having an inner diameter of 60 mm and a stroke of 15 to 30 mm, two regenerators 3 each having a length in the axial direction of 100 mm and inner diameters of 34 mm and 28 mm, respectively, a pulse tube 5 having an inner diameter of 15 mm and a length in the axial direction of 150 mm, and a buffer tank 16 having an inner volume of 1000 cc.

Figure 8:
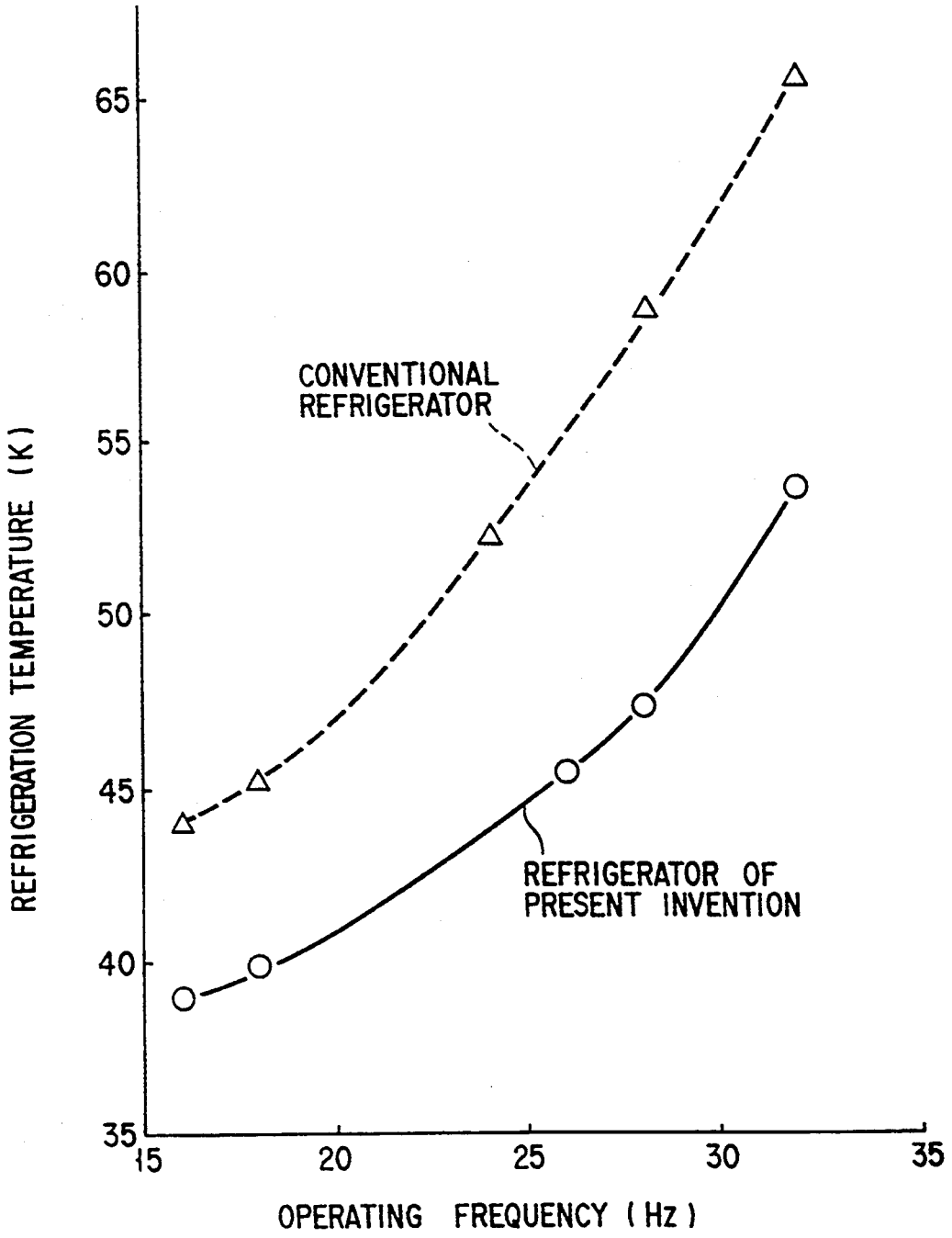
FIG. 8 is a graph showing the cooling temperature characteristics of the pulse tube refrigerator shown in FIG. 7 in comparison with those of the conventional pulse tube refrigerator.
Figure 9:
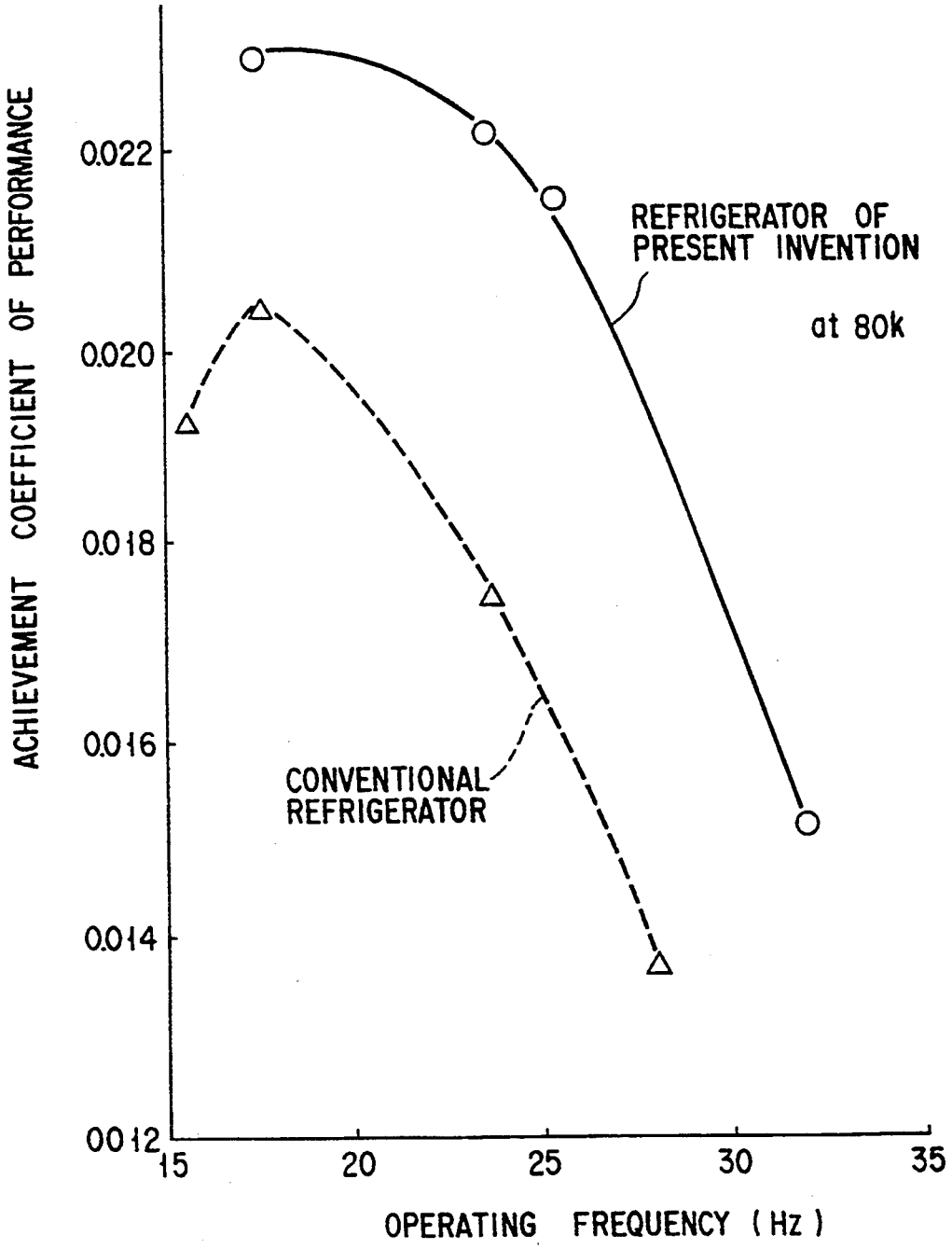
FIG. 9 is a graph showing the achievement coefficient characteristics at 80K of the pulse tube refrigerator shown in FIG. 7 in comparison with those of the conventional pulse tube refrigerator.

The relationship between the operating frequency and the refrigerating temperature which can be reached was examined with respect to the pulse tube refrigerator of the conditions given above. FIG. 8 shows the results. Also examined was the relationship between the operating frequency and the achievement coefficient of performance at 80K, i.e., the ratio of the refrigeration capacity at 80K to the input to the refrigerator. FIG. 9 shows the results. In each of FIGS. 8 and 9, a solid line denotes the characteristics of the refrigerator of the present invention, with a broken line denoting the characteristics of the conventional refrigerator shown in FIG. 2. As apparent from FIGS. 8 and 9, the refrigerator of the present invention permits markedly increasing the coldness generation, leading to a marked improvement in efficiency, compared with the conventional refrigerator.

Figure 10:
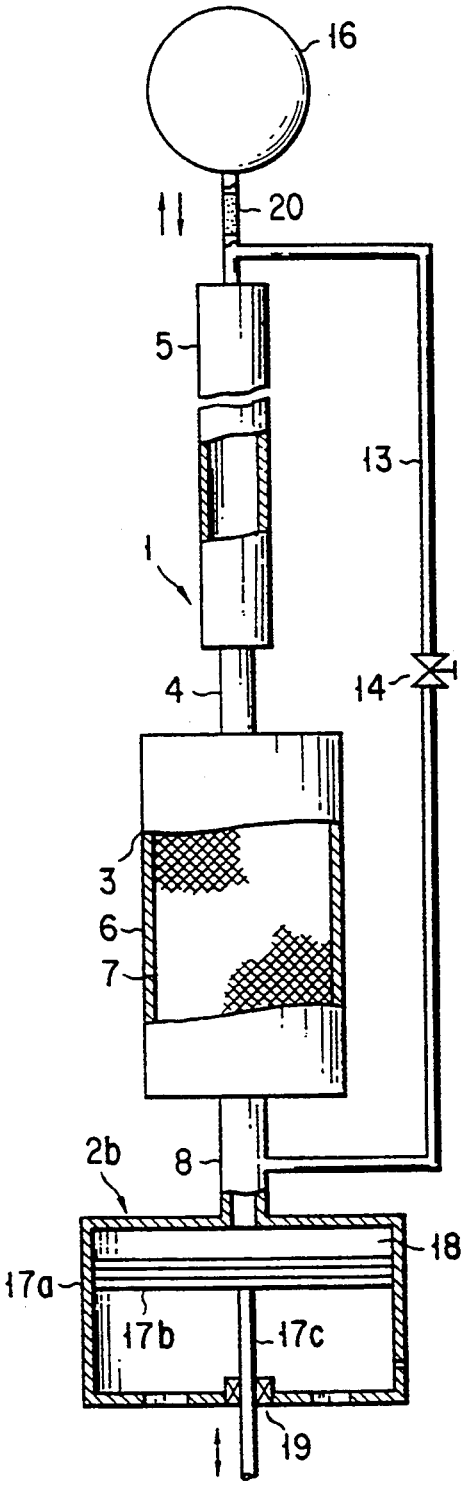
FIG. 10 schematically shows the construction of a pulse tube refrigerator according to another embodiment of the present invention.

FIG. 10 schematically shows the construction of a pulse tube refrigerator according to a third embodiment of the present invention. The pulse tube refrigerator of the present invention shown in FIG. 10 differs from the conventional refrigerator shown in FIG. 2 in that, in the refrigerator of the present invention, a porous plug 20 having appropriate fine gas passageways is interposed between the distal end portion of the pulse tube 5 and the buffer tank 16 in place of the orifice valve used in the conventional refrigerator. The refrigerator shown in FIG. 10 is equal to the conventional refrigerator in the refrigeration principle itself. However, the porous plug 20 replacing the orifice valve used in the conventional refrigerator permits increasing the phase difference between the pressure fluctuation and the displacement of the coolant gas within the pulse tube 5, leading to an improved efficiency.

Figure 11:
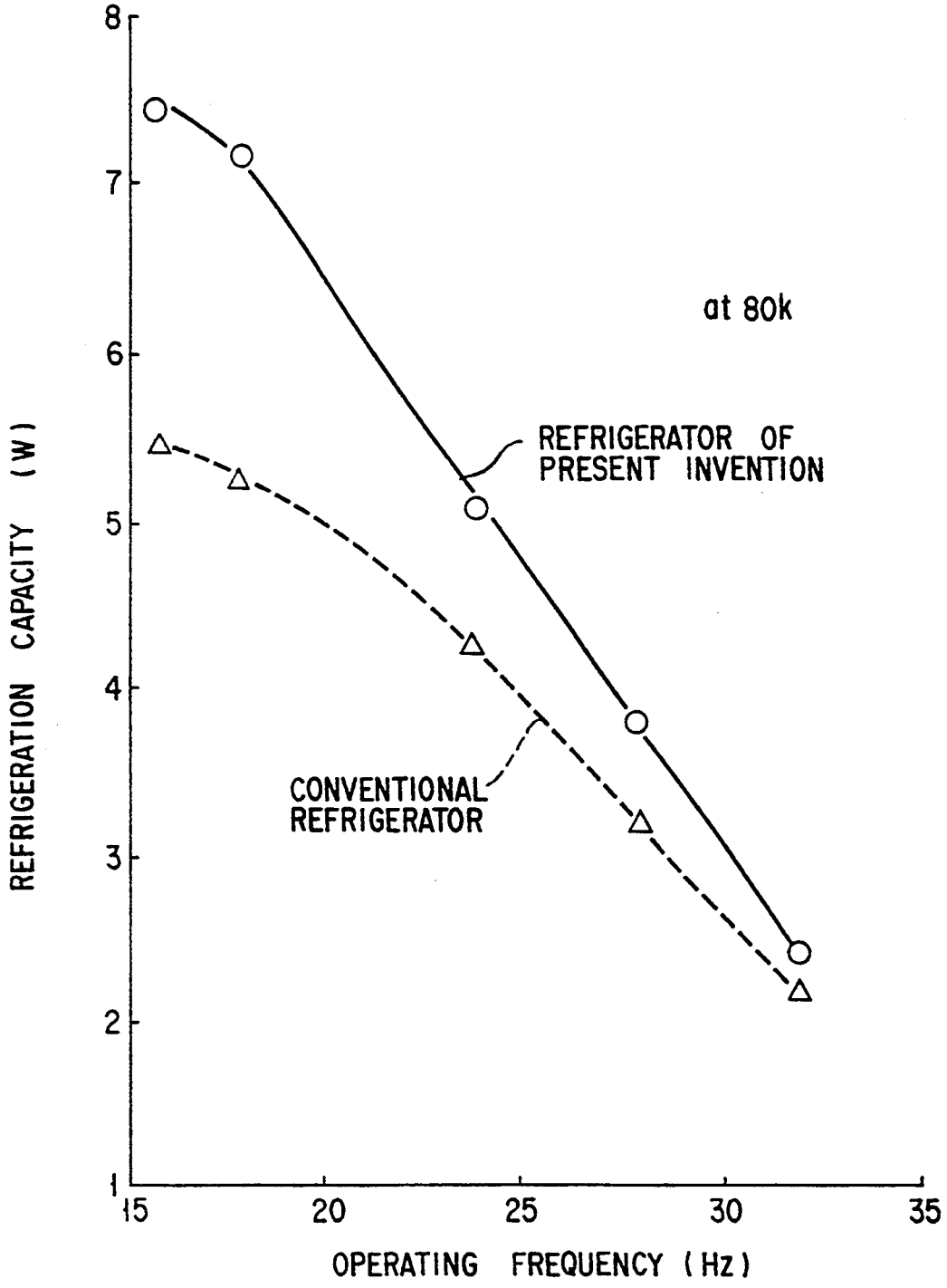
FIG. 11 is a graph showing the refrigerating characteristics of the pulse tube refrigerator shown in FIG. 10 in comparison with those of the conventional pulse tube refrigerator.

FIG. 11 shows the relationship between the operating frequency and the refrigeration capacity at 80K in respect of the pulse tube refrigerator of the present invention shown in FIG. 10 and the conventional pulse tube refrigerator shown in FIG. 2. Used in the experiment to obtain the data shown in FIG. 11 was a refrigerator comprising a gas compressor 2 having an inner diameter of 60 and a stroke of 15 to 30 mm, two regenerators each having a length in the axial direction of 100 mm and inner diameters of 34 mm and 28 mm, respectively, a pulse tube 5 having an inner diameter of 18 mm and a length in the axial direction of 150 mm, and a buffer tank 16 having an inner volume of 1000 cc.

In the graph of FIG. 11, the operating frequency is plotted on the abscissa, with the refrigeration capacity being plotted on the ordinate. The broken line in the graph denotes the characteristics of the conventional refrigerator, with the solid line denoting the characteristics of the refrigerator of the present invention shown in FIG. 10. As seen from the graph, the refrigerator of the present invention, which permits increasing the coldness generation, exhibits a high refrigeration capacity, compared with the conventional refrigerator. Incidentally, it is possible to omit the double inlet line 13 from the refrigerator of the present invention. Even in this case, the porous plug 20 included in the refrigerator is effective for producing a prominent effect.

Figure 12:
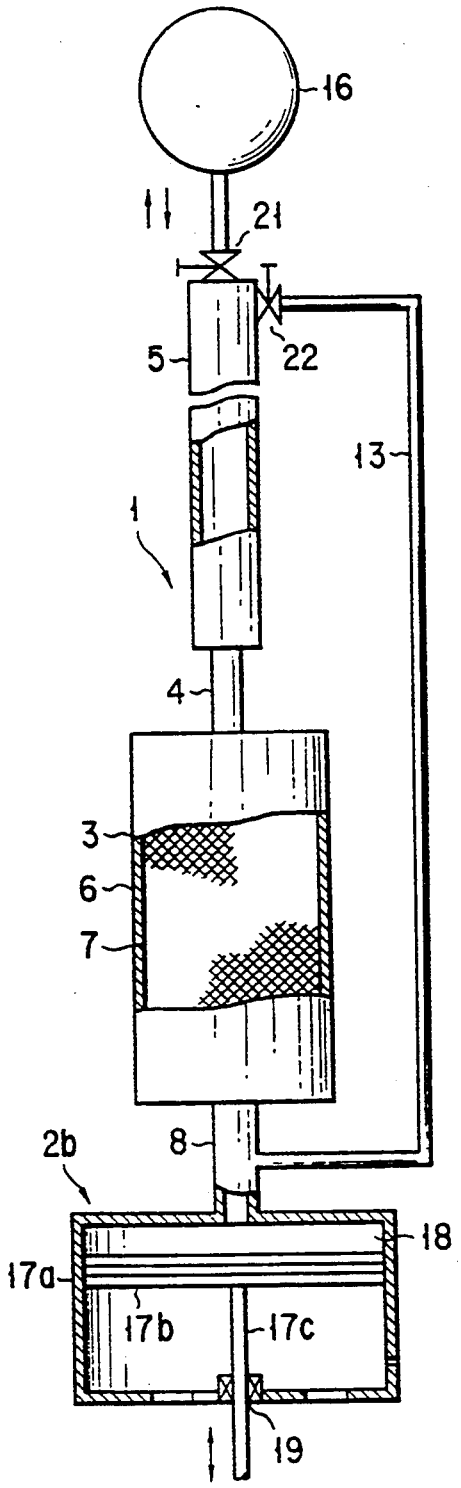
FIG. 12 schematically shows the construction of a pulse tube refrigerator according to another embodiment of the present invention.

FIG. 12 shows a pulse tube refrigerator according to a fourth embodiment of the present invention. The refrigerator shown in FIG. 12 is substantially equal to that shown in FIG. 11, except that, in the refrigerator shown in FIG. 12, the distal end portion of the pulse tube 5 is connected to the buffer tank 16 via an orifice valve 21 which is directly connected to the distal end portion of the pulse tube 5, and that the distal end portion of the pulse tube 5 is also connected to the double inlet line 13 via a control valve 22 which is directly connected to the distal end portion of the pulse tube 5.

The refrigerator shown in FIG. 12 is equal to the refrigerator shown in FIG. 10 in the refrigeration principle itself. However, the piping volume between the pulse tube 5 and the orifice valve 21 and the piping volume between the pulse tube 5 and the control valve 22 can be eliminated in the refrigerator shown in FIG. 11. It follows that it is possible to increase the difference in phase between the pressure fluctuation and the displacement of the coolant gas within the pulse tube 5, leading to an improved efficiency and, thus, to a lower temperature which can be arrived at. Incidentally, even if the double inlet line 13 is not included in the refrigerator shown in FIG. 12, the particular effect described above can be obtained by mounting the orifice valve in the particular fashion described above.

Figure 13:
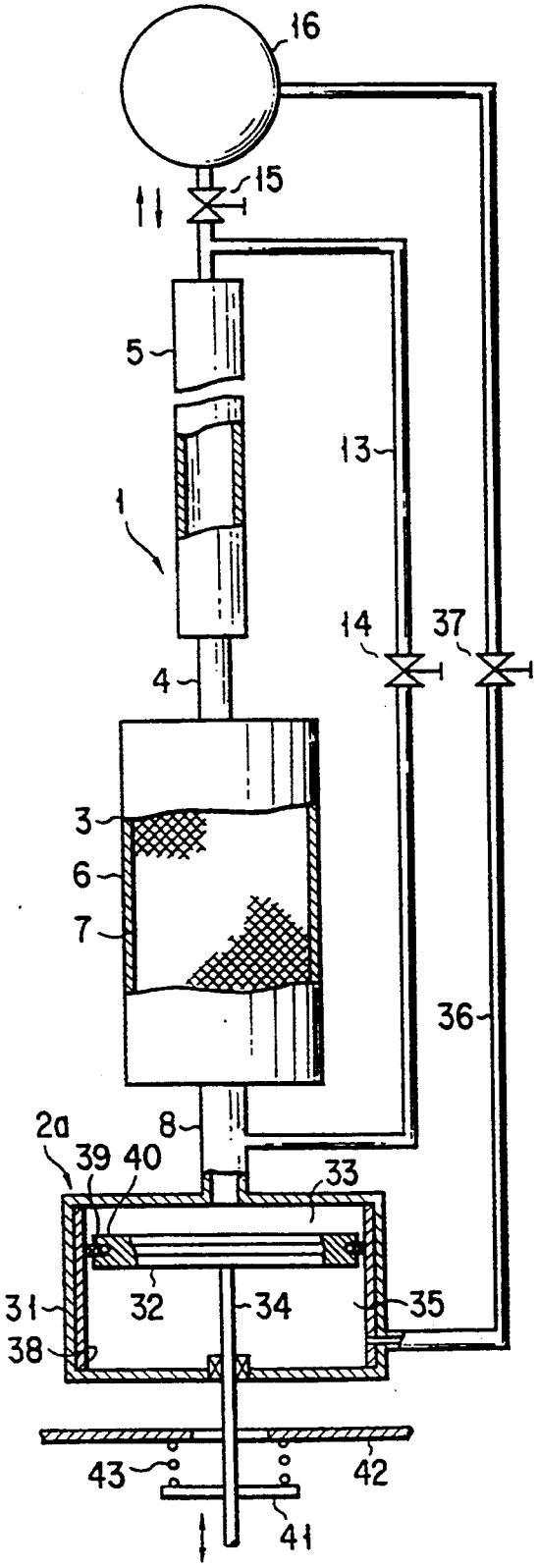
FIG. 13 schematically shows the construction of a pulse tube refrigerator according to still another embodiment of the present invention.

FIG. 13 schematically shows the construction of a pulse tube refrigerator according to a fifth embodiment of the present invention. The refrigerator shown in FIG. 13 differs from the refrigerator shown in FIG. 7 in construction of the gas compressor.

The pulse tube refrigerator shown in FIG. 13 comprises a gas compressor 2*a* of reciprocating type. As seen from the drawing, the gas compressor 2*a* comprises a compression chamber 33 consisting of a cylinder 31 and a piston 32. The bottom wall of the cylinder 31 is closed, and a piston rod 34 slidably extends hermetically through the closed bottom wall so as to be joined to, for example, a voice coil motor type driving apparatus. Further, a back chamber 35 is formed within the cylinder 31. The back chamber 35, which is partitioned from the compression chamber 33 by the piston 32, communicates with the buffer tank 17 via a pipe 36 and a flow rate control valve 37.

The side wall of the cylinder 31 is of a double wall structure and comprises an inner wall 38 made of a ceramic material. An annular groove is formed along the circumferential outer surface of the piston 32. A seal ring 39 serving to hermetically seal the clearance between the cylinder 31 and the piston 32 is engaged with the annular groove. The seal ring 39 is weakly 10 pressed against the inner wall 38 by a spring 40 mounted within the annular groove. Further, a flange 41 is mounted to the outwardly projecting portion of the piston rod 34, and a coil spring 43 serving to support the movable members including the piston 32 is mounted in the clearance between the flange 41 and a stationary member 42. The spring constant of the coil spring 43 is set smaller than that of the gas spring constant of the coolant gas acting on the piston when the piston 32 is moved upward in the drawing so as to diminish the inner volume of the compression chamber 33, the compressed coolant gas flows partly into the pulse tube 5 via the regenerator 3 and partly into the buffer tank 16 and into the pulse tube 5 via the double inlet line 13. In this step, coolant gas within the buffer tank 16 flows partly into the back chamber 35 via the pipe 36. When the piston 32 is moved downward in the next step, the coolant gas within the pulse tube 5 flows partly into the compression chamber 33 via the regenerator 3 and partly through the double inlet line 13 into the compression chamber 33. In this step, the coolant gas within the buffer tank 16 flows into the double inlet line 13 and the pulse tube 5. The particular flow of the coolant gas brings about a pressure fluctuation within the pulse tube 5 so as to generate coldness.

It should be noted that, in the particular construction described above, the spring constant of the coil spring 43 is set smaller than the gas spring constant of the coolant gas acting on the piston 32, as described previously. Since the movable members including the piston 32 is supported by the particular coil spring 43, the piston 32 is prevented from being inclined. It follows that the seal ring 39 is prevented from a so-called "one side abutment" so as to ensure the sealing between the cylinder 31 and the piston 32. In addition, the sliding resistance can also be diminished, leading to an improved efficiency of the refrigerator. What should also be noted is that the particular construction employed in the refrigerator shown in FIG. 13 makes it possible to allow the resonance frequency of the piston 32 to coincide with the frequency band which permits a high refrigerating efficiency by controlling the weight of the piston 32. It follows that the refrigerating efficiency can be further improved.

Figure 14:
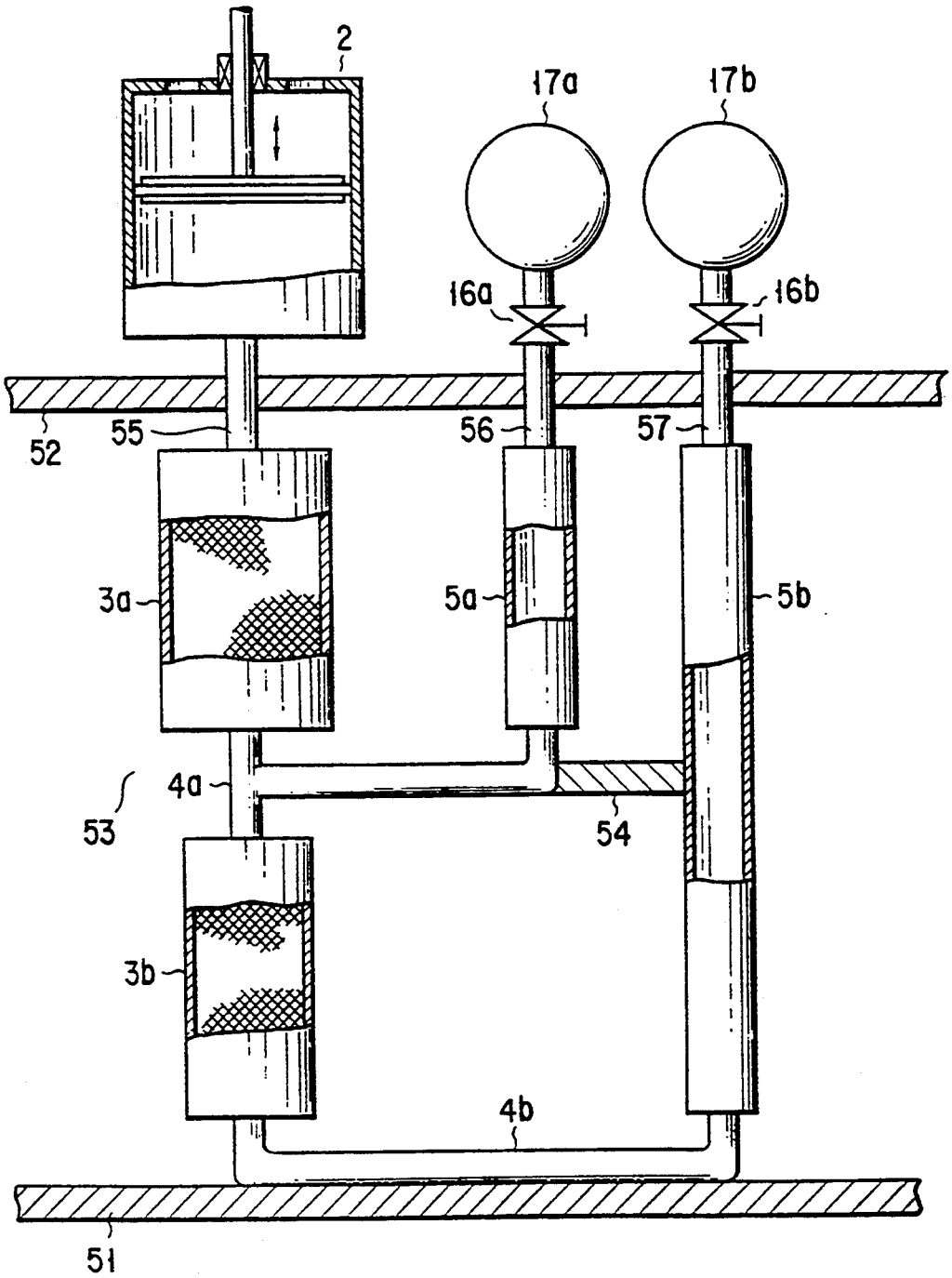
FIG. 14 exemplifies a case where a pulse tube refrigerator is incorporated in two stages.

FIG. 14 exemplifies how to use the pulse tube refrigerator of the present invention. In this example, the inner vessel of a heat insulating container of a double vessel type is cooled by a pulse tube refrigerator. Specifically, the gist portion of a pulse tube refrigerator is disposed within a vacuum heat insulating space 53 defined between an inner vessel 51 and an outer vessel 52 of a heat insulating container of a double vessel structure. The inner vessel corresponds to a body to be refrigerated, and is cooled to a cryogenic temperature.

As seen from the drawing, a first stage regenerator 3*a*, a low temperature heat exchange portion 4*a*, and a first stage pulse tube 5*a* are connected in series within the vacuum heat insulating space 53. The low temperature heat exchange portion 4*a* is connected to a second stage pulse tube 5*b* via a second stage regenerator 3*b* and a low temperature heat exchange portion 4*b* which is thermally connected to the inner vessel 51. In this case, the second stage pulse tube 5*b* is set at least twice as long as the first stage pulse tube 5*a*. Also, the low temperature heat exchange portion 4*a* is connected to the outer circumferential surface of the second stage pulse tube 5*a* in its intermediate portion in the axial direction by a heat conductor 54.

The inlet port of the first stage regenerator 3*a* is connected to the gas compressor 2*b* via a pipe 55 hermetically extending through the wall of the outer vessel 52. Likewise, the distal end of the first stage pulse tube 5*a* and the distal end of the second stage pulse tube 5*b* are connected to buffer tanks 17*a*, 17*b* via pipes 56, 57 hermetically extending through the wall of the outer vessel 52 and orifice valves 16*a*, 16*b*, respectively.

In the arrangement described above, the temperature of the low temperature heat exchange portion 4*b* is made lower than the temperature of the low temperature heat exchange portion 4*a*. The inner vessel 51 is cooled by the coldness generated from the low temperature heat exchange portion 4*b*. It should also be noted that the two orifice valves 16*a*, 16*b* and the two buffer tanks 17*a*, 17*b* are exposed to the outside. It follows that the control and maintenance of the system can be facilitated. Of course, the pulse tube refrigerator arranged in this fashion also permits improving the refrigerating efficiency as in the embodiments described previously.

Figure 15:
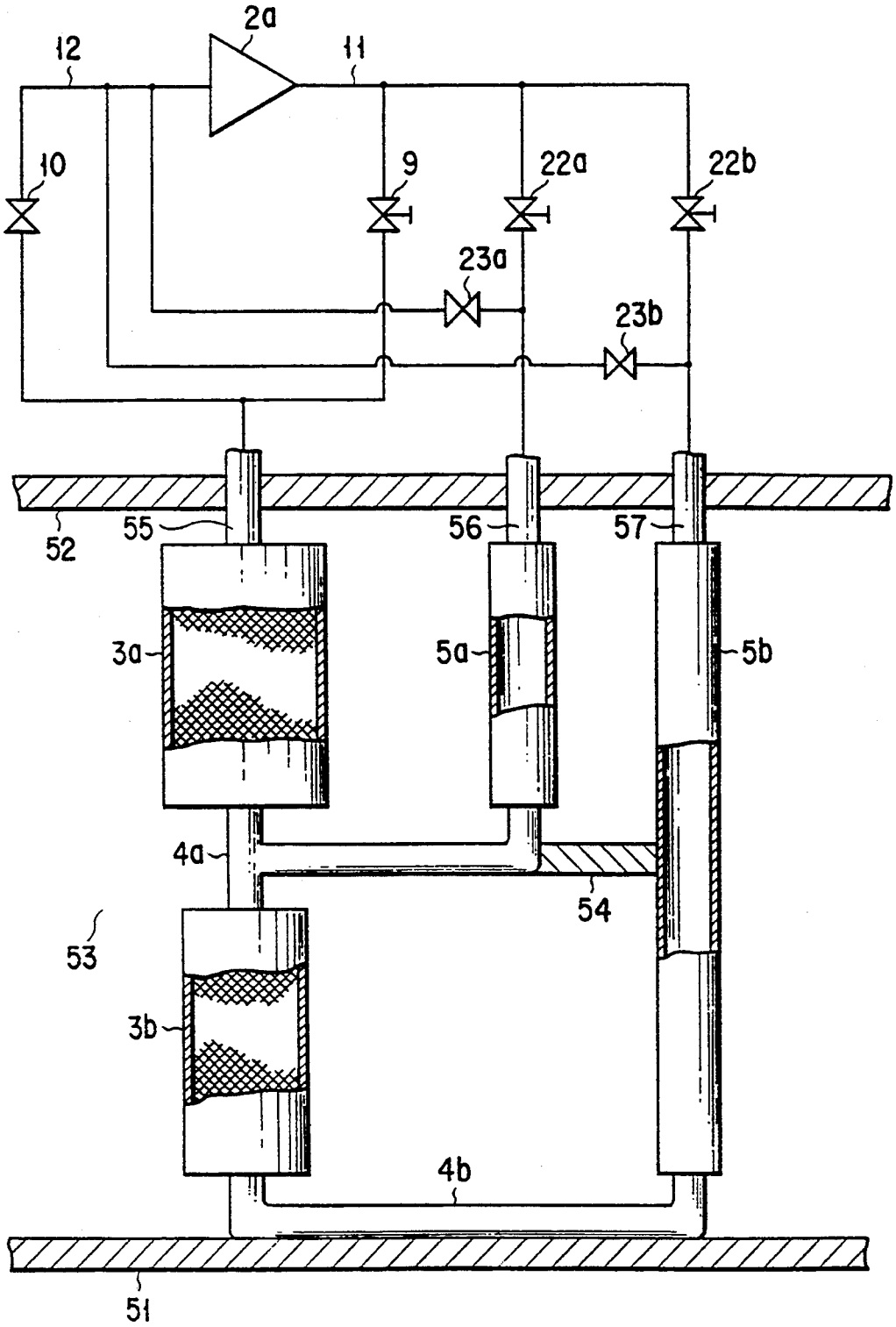
FIG. 15 exemplifies another case where a pulse tube refrigerator is incorporated in two stages.

FIG. 15 covers the case where a rotary gas compressor 2*a* is used as a gas compressor in the two stage pulse tube refrigerator shown in FIG. 14. In the pulse tube refrigerator shown in FIG. 15, the inlet port of the first stage regenerator 3*a* is connected to the discharge port of the gas compressor 2*a* via the pipe 55 hermetically extending through the wall of the outer vessel 52 and the high pressure valve 9, and is also connected to the suction port of the gas compressor 2*a* via the pipe 55 and the low pressure valve 10.

The distal end of the first stage pulse tube 5*a* is connected to that portion of the discharge passageway 11 of the gas compressor 2*a* which is positioned upstream of the high pressure valve 9 via the first auxiliary high pressure valve 22*a*, and is also connected to that portion of the suction passageway 12 of the gas compressor 2*a* which is positioned downstream of the low pressure valve 10 via the first auxiliary low pressure valve 23*a*. On the other hand, the distal end of the second stage pulse tube 5*b* is connected to that portion of the discharge passageway 11 of the gas compressor 2*a* which is positioned upstream of the high pressure valve 9 via the second auxiliary high pressure valve 22*b*, and is also connected to that portion of the suction passageway 12 of the gas compressor 2*a* which is positioned downstream of the low pressure valve 10 via the second auxiliary low pressure valve 23*b*.

Figure 16:
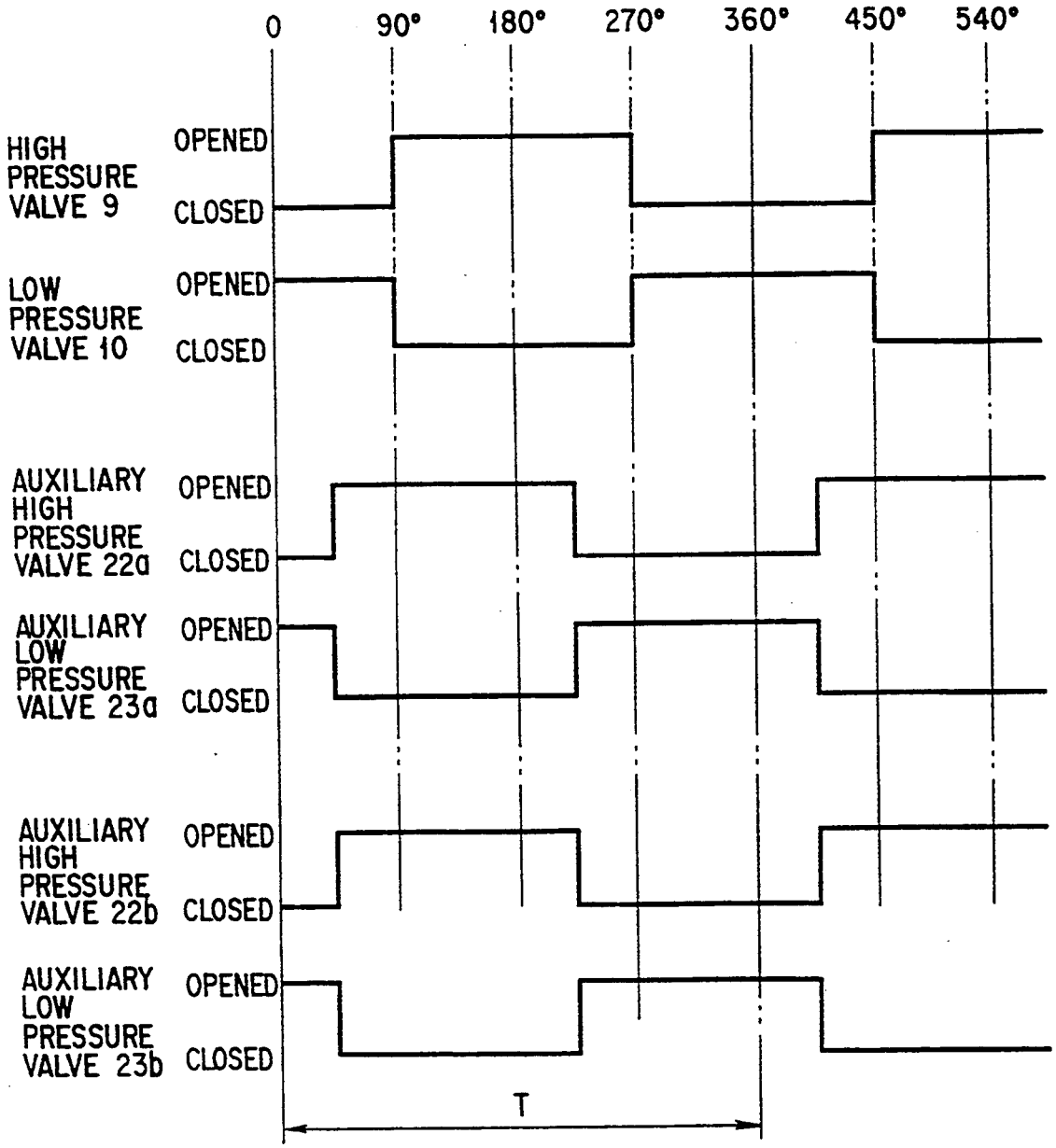
FIG. 16 is a timing chart showing the timing of opening/closing the valves of the pulse tube refrigerators shown in FIG. 15.

The opening/closing of each of the valves included in the system is controlled by a valve controller (not shown) in accordance with the timing chart shown in FIG. 16.

In the example shown in FIG. 16, the high pressure valve 9 and the low pressure valve 10 are controlled to be alternately opened/closed. Specifically, the high pressure valve 9 is kept opened while the low pressure valve 10 is kept closed, and vice versa. In addition, the opening period is equal to the closing period. Further, the auxiliary high pressure valves 22*a*, 22*b* are opened/closed earlier by 45° than the high pressure valve 9. For example, the high pressure valve 9 is opened after the auxiliary high pressure valves 22*a*, 22*b* are opened. Likewise, the auxiliary low pressure valves 23*a*, 23*b* are opened/closed earlier by 45° than the low pressure valve 10. For example, the low pressure valve 10 is closed after the auxiliary low pressure valves 23*a*, 23*b* are closed. It follows that the auxiliary high pressure valves 22*a*, 22*b* and the auxiliary low pressure valves 23*a*, 23*b* permit the distal end portions of the pulse tubes 5*a*, 5*b* to communicate with the discharge port and with the suction port of the gas compressor 2 regardless of the opening/closing states of the high pressure valve 9 and the low pressure valve 10.

In the timing chart shown in FIG. 16, the auxiliary high pressure valves 22*a* and 22*b* are controlled with substantially the same timing. Likewise, the auxiliary low pressure valves 23*a* and 23*b* are controlled with substantially the same timing. However, it is also possible to open/close one of, for example, the auxiliary high pressure valves 22*a* and 22*b* somewhat earlier than the other. Likewise, one of the auxiliary low pressure valves 23*a* and 23*b* can be opened/closed somewhat earlier than the other. In this case, the phase difference can be further enlarged between the pressure fluctuation and the displacement of the coolant gas within each of the pulse tubes 5*a*, 5*b*. To be brief, the auxiliary high pressure valves 22*a* and 22*b* need not be controlled with the same timing as far as these valves 22*a*, 22*b* are opened/closed somewhat earlier than the high pressure valve 9. Likewise, the auxiliary low pressure valves 23*a* and 23*b* need not be controlled with the same timing as far as these valves 23*a*, 23*b* are opened/closed somewhat earlier than the low pressure valve 10. Where the auxiliary high pressure valves 22*a*, 22*b*, and the auxiliary low pressure valves 23a, 23b are controlled in the same timing, each only one valve suffices.

The arrangement shown in FIG. 15 and the opening/closing operation of the valves shown in FIG. 16 permits the temperature of the low temperature heat exchange portion 4*b* to be lower than the temperature of the low temperature heat exchange portion 4*a*. The inner vessel 51 is cooled by the coldness of the low temperature heat exchange portion 4*b* which is in direct contact with the inner vessel 51 what should also be noted is that the heat dissipation can be performed in a region outside the outer vessel 52. In other words, the heat dissipation can be performed at room temperature, for example, by cooling water.

In each of the multi-stage pulse tube refrigerators shown in FIGS. 14 and 15, it is also possible to improve the refrigerating efficiency by employing the particular technique described in conjunction with each of the embodiments described previously.

Figure 17:
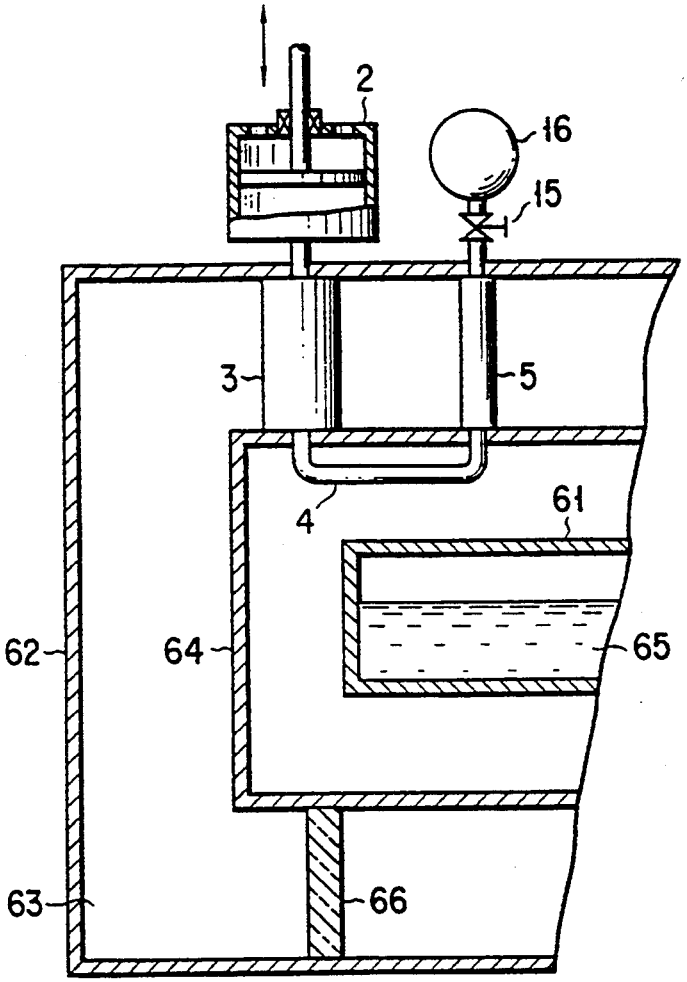
FIG. 17 shows another example of using a pulse tube refrigerator.

FIG. 17 exemplifies another case of using the pulse tube refrigerator of the present invention.

In a heat-insulted container provided with a vacuum heat insulating space, a heat shielding board is disposed in general within the vacuum heat insulating space in order to prevent heat entry due to radiation. In this case, it is necessary to cool the heat shielding board to a predetermined temperature. In the example shown in FIG. 17, a pulse tube refrigerator is used for cooling and supporting the heat shielding board. Specifically, a heat shielding board 64 is disposed within a vacuum heat insulating space defined between an inner vessel 61 and an outer vessel 62 of a heatinsulated container. As seen from the drawing, the heat insulating board 64 is disposed within the vacuum heat insulating space 63 to surround the inner vessel 61.

It should be noted that the regenerator 3 and the pulse tube 5 included in a pulse tube refrigerator are arranged within the space defined between the outer vessel 62 and the heat shielding board 64. As seen from the drawing, these regenerator 3 and the pulse tube 5 are arranged in a manner to support the outer vessel 62 and the heat shielding board 64. It is also seen that the low temperature heat exchange portion 4 of the pulse tube refrigerator is thermally connected to the heat insulating board 64. Incidentally, a reference numeral 65 in FIG. 17 denotes a cryogenic liquid such as a liquid helium, with a reference numeral 66 denoting a heat insulating support member.

In the example shown in FIG. 17, only one pulse tube refrigerator is included in the system. However, it is of course possible to substitute a plurality of pulse tube refrigerators for a plurality of heat insulating support members 66 serving to support the heat shielding board 64. Of course, all the heat insulating support members 66 may be replaced by the pulse tube refrigerators of the present invention.

The present invention need not be restricted to the embodiments described above. For example, a refrigerant of the same material is loaded within the entire region of the regenerator in each of the embodiments described previously. However, it is of course possible for the refrigerant to be formed of different kinds of refrigerants. For example, where both a stainless steel mesh and a copper mesh are used as the refrigerants, it is desirable to load the stainless steel mesh on the high temperature side of the regenerator, with the copper mesh being loaded on the low temperature side of the regenerator, so as to improve the refrigerating efficiency. In short, a material having a large specific heat should be disposed on the low temperature side. It is also possible to substitute the reciprocating gas compressor for the rotary gas compressor, and vice versa. In the case of using a reciprocating gas compressor in place of a rotary gas compressor, it is of course necessary to use a valve for switching the discharge-suction function.

Figure 18:
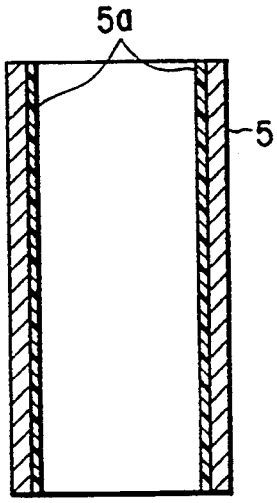
FIG. 18 is a cross sectional view showing a pulse tube having a coating applied to the inner surface.

Further, it is desirable to apply a coating layer 5*a* to the inner surface of the pulse tube 5, as shown in FIG. 18. The coating layer 5*a* should be formed of a material having a thermal expansion coefficient smaller than that of the material for forming the pulse tube 5. The particular coating layer 5*a* applied to the inner surface of the pulse tube makes it possible to further increase the difference in phase between the pressure fluctuation and the displacement of the coolant gas within the pulse tube. The material having a small thermal diffusion coefficient, which can be used for forming the coating layer 5*a*, includes, for example, a fluorine resin, silicone resin, and acrylic resin. The thickness of the coating layer 5*a* should desirably be 0.2 to 1 mm.

Further, the technical idea employed in the embodiments directed to a pulse tube refrigerator provided with an orifice valve and a buffer tank can also be applied to a pulse tube refrigerator which is not provided with such members of the refrigerator. Still further, in the embodiments described in conjunction with the accompanying drawings, the technical idea of the present invention is applied to a pulse tube refrigerator comprising one or two cooling stages. However, it is of course possible to apply the technical idea of the present invention to a pulse tube refrigerator comprising three or more cooling stages.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A pulse tube refrigerator system, comprising:

a first regenerator having an inlet port and an outlet port;

a first pulse tube having one end portion connected in series to the outlet port of said first regenerator;

a second regenerator having an inlet port and an outlet port, said inlet port being connected to the outlet port of said first regenerator;

a second pulse tube having one end portion connected in series to the outlet port of said second regenerator;

a housing containing said first regenerator, said first pulse tube, said second regenerator, and said second regenerator;

a first conduit hermetically extending through a wall of said housing and connected to another end portion of said first pulse tube;

a second conduit hermetically extending through a wall of said housing and connected to another end portion of said second pulse tube; and a gas compressor connected to the inlet port of said first regenerator by means of a pipe hermetically extending through a wall of said housing.

2. The pulse tube regenerator system according to claim 1, further comprising:

a first heat exchange portion formed at a connecting portion between said first regenerator and said first pulse tube; and a second heat exchange portion formed at a connecting portion between said second regenerator and said second pulse tube.

3. The pulse tube regenerator system according to claim 1, wherein said housing includes a first vessel and a second vessel contained in said first vessel, and a space between said first vessel and said second vessel constitutes a vacuum heat insulating space.

4. The pulse tube regenerator system according to claim 3, wherein said first regenerator, said first pulse tube, said second regenerator and said second pulse tube are arranged in said vacuum heat insulating space.

5. The pulse tube regenerator system according to claim 1, wherein said second pulse tube is longer than said first pulse tube.

6. The pulse tube regenerator system according to claim 1, wherein said second pulse tube is at least twice as long as said first pulse tube.

7. The pulse tube regenerator system according to claim 1, further comprising a heat conductor for thermally connecting said second pulse tube to a heat exchange portion formed at a connecting portion between said first regenerator and said first pulse tube.

8. The pulse tube regenerator system according to claim 1, wherein a refrigerant is housed in said first and second regenerators.

9. The pulse tube regenerator system according to claim 1, wherein a first refrigerant is housed in said first regenerator, and a second refrigerant made of a material different from that of said first refrigerant is housed in said second regenerator.

10. The pulse tube regenerator system according to claim 1, further comprising a first buffer tank connected to the other end portion of said first conduit.

11. The pulse tube regenerator system according to claim 1, further comprising a second buffer tank connected to the other end portion of said second conduit.

12. The pulse tube regenerator system according to claim 10, further comprising a first orifice valve arranged in said first conduit.

13. The pulse tube regenerator system according to claim 11, further comprising a second orifice valve arranged in said second conduit.

14. The pulse tube regenerator system according to claim 10, further comprising a first porous plug having fine gas passageways and arranged in said first conduit.

15. The pulse tube regenerator system according to claim 11, further comprising a second porous plug having fine gas passageways and arranged in said second conduit.

16. The pulse tube refrigerator system according to claim 1, wherein a coating layer formed of a material having a thermal diffusion coefficient smaller than that of the material for forming the pulse tube is applied to the inner surface of the first or second pulse tube.

17. The pulse tube refrigerator system according to claim 16, wherein the coating layer applied to the inner surface of the pulse tube is formed of a material selected from the group consisting of a fluorine resin, acrylic resin and silicone resin.

18. The pulse tube refrigerator system according to claim 16, wherein the coating layer applied to the inner surface of the pulse tube has a thickness of 0.2 to 1 $\mu$m.

19. The pulse tube refrigerator system according to claim 1, wherein said gas compressor is of a rotary type.

20. The pulse tube refrigerator system according to claim 1, further comprising:

a first valve disposed between the discharge port of the gas compressor and the inlet port of the first regenerator;

a second valve disposed between the suction port of the gas compressor and the inlet port of the first regenerator; and a first valve control means for selectively opening/-closing alternately the first and second valves to permit a high pressure coolant gas discharged from the discharge port of the gas compressor to be guided into the first and second pulse tubes through the first and second regenerators and, then, to permit said coolant gas to be sucked into the gas compressor through the suction port thereof via the reverse passageway so as to generate coldness.

21. The pulse tube refrigerator system according to claim 20, further comprising:

a third valve disposed between the other end portion of the first pulse tube and the discharge port of the gas compressor;

a fourth valve disposed between the other end potion of the first pulse tube and the suction port of the gas compressor;

a fifth valve disposed between the other end portion of the second pulse tube and the discharge port of the gas compressor;

a sixth valve disposed between the other end portion of the second pulse tube and the suction port of the gas compressor; and a second valve control means serving to open/close the third, fourth, fifth and sixth valves in relation to the opening/closing of the first and second valves.

22. A pulse tube regenerator system, comprising:

a regenerator having an inlet port and an outlet port;

a pulse tube having one end portion connected in series to the outlet port of the regenerator;

a heat exchange portion formed at a connecting portion between said regenerator and said pulse tube;

a first vessel containing said regenerator and said pulse tube;

a second vessel housed in said first vessel and cooled by said heat exchange portion; and a gas compressor connected to the inlet port of said regenerator by means of a pipe hermetically extending through a wall of said first vessel.

23. The pulse tube regenerator system according to claim 22, wherein a space between said first vessel and said second vessel constitutes a vacuum heat insulating space, and said regenerator and said pulse tube are arranged in said vacuum heat insulating space.

24. The pulse tube regenerator system according to claim 22, wherein an atmosphere in said second vessel is maintained in a cryogenic condition.

25. The pulse tube regenerator system according to claim 22, further comprising a pipe connected to another end portion of said pulse tube and hermetically extending through a wall of said first vessel.

26. The pulse tube regenerator system according to claim 22, wherein a refrigerant is housed in said regenerators.

27. The pulse tube regenerator system according to claim 25, further comprising a buffer tank connected to the other end portion of said pipe.

28. The pulse tube regenerator system according to claim 27, further comprising an orifice valve arranged in said pipe.

29. The pulse tube regenerator system according to claim 27, further comprising a porous plug having fine gas passageways and arranged in said pipe.

30. The pulse tube regenerator system according to claim 22, wherein a coating layer formed of a material having a thermal diffusion coefficient smaller than that of the material for forming the pulse tube is applied to the inner surface of the pulse tube.

31. The pulse tube refrigerator system according to claim 30, wherein the coating layer applied to the inner surface of the pulse tube is formed of a material selected from the group consisting of a fluorine resin, acrylic resin and silicone resin.

32. The pulse tube refrigerator system according to claim 30, wherein the coating layer applied to the inner surface of the pulse tube has a thickness of 0.2 to 1 mm.

33. The pulse tube refrigerator system according to claim 22, wherein said gas compressor is of a rotary type.

34. The pulse tube regenerator system according to claim 22, further comprising:

a first valve disposed between the discharge port of the gas compressor and the inlet port of the regenerator;

a second valve disposed between the suction port of the gas compressor and the inlet port of the regenerator;

a first valve control means for selectively opening/-closing alternately the first and second valves to permit a high pressure coolant gas discharged from the discharge port of the gas compressor to be guided into the pulse tube through the regenerator and, then, to permit said coolant gas to be sucked into the gas compressor through the suction port thereof via the reverse passageway so as to generate coldness;

a third valve disposed between the other end portion of the pulse tube and the discharge port of the gas compressor;

a fourth valve disposed between the other end portion of the pulse tube and the suction port of the gas compressor; and a second valve control means serving to open/close the third and fourth valves in relation to the opening/closing of the first and second valves.

35. A pulse tube refrigerator system, comprising:

a first regenerator having an inlet port and an outlet port;

a first pulse tube having one end portion connected in series to the outlet port of said first regenerator;

a second regenerator having an inlet port and an outlet port, said inlet port being connected to the outlet port of said first regenerator;

a second pulse tube having one end connected in series to the outlet port of said second regenerator;

a heat conductor for thermally connecting said second pulse tube to a heat exchange portion formed at a connecting portion between said first regenerator and said first pulse tube;

a housing containing said first regenerator, said first pulse tube, said second regenerator, and said second pulse tube; and a gas compressor connected to the inlet port of said first regenerator by means of a pipe hermetically extending trough a wall of said housing.

36. The pulse tube regenerator system according to claim 35, further comprising:

a first pipe connected to another end portion of said first pulse tube and hermetically extending through a wall of said housing; and and second pipe connected to another end portion of said second pulse tube and hermetically extending through a wall of said housing.

37. The pulse tube regenerator system according to claim 35, further comprising:

a first heat exchange portion formed at a connecting portion between said first regenerator and said first pulse tube; and a second heat exchange portion formed at a connecting portion between said second regenerator and said second pulse tube.

38. The pulse tube regenerator system according to claim 35, wherein said housing includes a first vessel and a second vessel contained in said first vessel, and a space between said first vessel and said second vessel constitutes a vacuum heat insulating space.

39. The pulse tube regenerator system according to claim 38, wherein said first regenerator, said first pulse tube, said second regenerator and said second pulse tube are arranged in said vacuum heat insulating space.

40. The pulse tube regenerator system according to claim 35, wherein said second pulse tube is longer than said first pulse tube.

41. The pulse tube regenerator system according to claim 35, wherein said second pulse tube is at least twice as long as said first pulse tube.

* * * * *